United States Patent [19]

Madgavkar

[11] Patent Number: 4,985,139

[45] Date of Patent: Jan. 15, 1991

[54] TWO-STEP HETEROCYCLIC NITROGEN EXTRACTION FROM PETROLEUM OILS WITH REDUCED REFINERY EQUIPMENT

[75] Inventor: Ajay M. Madgavkar, Katy, Tex.

[73] Assignee: Shell Oil Company, Houston, Tex.

[21] Appl. No.: 219,509

[22] Filed: Jul. 14, 1988

[51] Int. Cl.[5] ..... C10G 17/04; C10G 21/06

[52] U.S. Cl. ..... 208/321; 208/329; 208/323

[58] Field of Search ..... 208/87, 92, 312, 321, 208/315, 316, 282, 254 R, 329, 323

[56] References Cited

U.S. PATENT DOCUMENTS

| | | | |
|---|---|---|---|
| 1,686,136 | 10/1928 | Ihrig et al. | 260/269 |
| 2,263,175 | 11/1941 | Lazar et al. | 260/269 |
| 2,263,176 | 11/1941 | Lazar et al. | 260/269 |
| 2,779,709 | 1/1957 | Dale et al. | 208/321 |
| 2,800,427 | 7/1957 | Junk, Jr. et al. | 196/14.11 |
| 3,551,324 | 12/1970 | Lillard et al. | 208/87 |
| 4,272,361 | 6/1981 | Compton | 208/282 X |
| 4,332,675 | 6/1982 | Baset | 208/254 R |
| 4,332,676 | 6/1982 | Baset | 208/254 R |
| 4,409,092 | 10/1983 | Johnson et al. | 208/89 |
| 4,483,763 | 11/1984 | Kuk et al. | 208/254 H |
| 4,605,489 | 8/1986 | Madgavkar | 208/87 |
| 4,623,444 | 11/1986 | Che et al. | 208/92 |
| 4,671,865 | 6/1987 | Madgavkar | 208/96 |
| 4,790,930 | 12/1988 | Madgavkar et al. | 208/87 X |

OTHER PUBLICATIONS

Chemical Engineering, Oct. 17, 1983, "New Processes Star in Denver", pp. 3, 14–19.

*Primary Examiner*—Glenn Caldarola

*Attorney, Agent, or Firm*—Kimbley L. Muller

[57] ABSTRACT

A process is disclosed for the removal of basic heterocyclic nitrogen compounds from a petroleum crude oil or fraction thereof which comprises treating, the petroleum crude oil in a distillation zone to form a distillation bottoms stream which is rich in basic heterocyclic nitrogen compounds. This stream is passed without cooling or heat removal to a two-phase extraction zone with an extractant consisting essentially of an aqueous solution of a lower carboxylic acid and preferably having from 1 to 15 carbon atoms. The extractant complexes the basic heterocyclic nitrogen compound to produce a stream of petroleum crude oil or fraction thereof having a smaller content of heterocyclic nitrogen compounds and a stream comprising the lower carboxylic acid extractant with an increased quantity of basic heterocyclic nitrogen compounds. Both of these streams are passed to distillation without heating. The stream of petroleum crude having the smaller content of heterocyclic nitorgen compound is distilled into an overhead stream and a bottoms stream, the latter of which is hydrotreated to the product of this invention. The stream comprising the higher nitrogen content is passed, without heating, to a distillation zone wherein a stream very high in nitrogen content is removed and an extractant recycle stream is recovered. The extractant recycle stream is then recycled to the extraction zone.

12 Claims, 2 Drawing Sheets

TWO-STEP HETEROCYCLIC NITROGEN EXTRACTION FROM PETROLEUM OILS WITH REDUCED REFINERY EQUIPMENT

FIELD OF THE INVENTION

The field of this invention resides in the removal of nitrogen compounds from fossil fuels inclusive of petroleum oils. This invention seeks to vitiate problems of nitrogen content indigenous in petroleum oils such as those derived on the West Coast of the United States and in particular in the Los Angeles basin. These nefarious nitrogen compounds create a major problem in downstream processing of the crude oil by forming heterocyclic nitrogen compounds and amine compounds which act as a degradation agent for many of the metals used in the reactors and certain distillation units which are necessary to acquire the various substrates from the petroleum distillates. The nitrogen compounds are also known to be strong poisons for many catalysts used in refineries. Various prior methods have been employed for separating nitrogen compounds from crude oil such as the use of gaseous sulfur dioxide and the use of inorganic acid agents.

This invention seeks to eliminate uniphase treatment of a petroleum oil to concentrate and extract the nitrogen compounds. While it is not possible to feasibly remote all nitrogen compounds from petroleum oils, it is highly desirous that the content of the nitrogen compounds be reduced to a feasible minimum to reduce the poisoning of the catalyst in downstream processing and to mitigate hydrotreating of lubricants, fuel oils, etc., before theIr eventual end use. This unique two-step process first excises the heterocyclic nitrogen compounds via extraction with a lower aliphatic carboxylic acid of a mixture thereof and second hydrotreats the recovered petroleum oil to further lower nitrogen content. If desirable, the feedstream to the extraction unit can undergo pre-extraction distillation to arrive at a bottoms stream having an increased concentration of basic nitrogen compounds while the overhead stream may not necessitate processing by the process of this invention.

Current practice for excising these nitrogen compounds resides in hydrorefining a petroleum oil in the presence of hydrogen and a catalyst at high severities of temperature and pressure. This technique seeks to actually convert the nitrogen compounds to less troublesome nitrogen components which can be removed in downstream processing. This technique also results in a great economic disincentive to convert a nefarious compound to another less troublesome compound.

The field of this invention resides in a two-step nitrogen reduction process consisting of a first step of basic nitrogen extraction wherein the basic nitrogen concentration of the original feed is reduced by extraction with a carboxylic acid extractant followed by hydrotreating to remove the basIc nitrogen compounds of the recovered petroleum oil. This will result in an overall savings in total hydrogen consumption of the hyrorefining process. This reduction is substantial because certain basic nitrogen compounds consume a large amount of hydrogen to thereby eliminate them. The hydrotreating will be performed under less severe hydrotreating conditions as a result of the presence of a small concentration of basic nitrogen compound in the extraction zone raffinate stream. Use of this process will permit the convenient refining of many high basic nitrogen crude oil streams and fractions which, at best, were very costly to convert to more useful hydrocarbon.

The yield of this invention resides in a two-step nitrogen reduction process which takes advantage of the relatively low boiling points of water and organic acids as compared to the petroleum oil at atmospheric conditions to provide a more cost efficient process to eliminate the cooling step upstream of extraction as well as the heating step downstream of extraction and thereby provide for a distillation step downstream of extraction which would be easier to maintain without reducing yield.

The field of this invention is also concerned with a simplification of a two-step process for removing basic nitrogen compounds from a petroleum oil using hydrocarbon feed containing the basic nitrogen compound acquired at a relatively high temperature and performing extraction at that high temperature.

BACKGROUND OF THE INVENTION

In addition to the hydrorefining state-of-the-art practiced in the presence of a hydrorefining catalyst, hydrogen and high temperatures and pressures, other techniques have been disclosed for the removal of these nitrogen compounds. Two U.S. Pat. Nos. which have issued to Baset, 4,332,676 and 4,33Z,675, disclose a process for the removal of basic nitrogen compounds from organic streams inclusive of petroleum oils utilizing gaseous sulfur dioxide to thereby Precipitate a salt comprising the basic nitrogen compound, sulphur dioxide and water with downstream separation of the precipitated salt. Both of these patents concern a single-phase treatment system with the content of water in the seParation system in '675 being substantially eliminated and the quantity of water in '676 being such that only a single phase system is existent. In fact, in the latter reference the addition of water is limited to a concentration only to the extent that a two-phase liquid system will never be formed. It is also disclosed that a non-polar solvent can be utilized in the contacting step such as a petroleum ether, a lower paraffinic hydrocarbon or an aromatic hydrocarbon such as toluene. While the types of basic organic nitrogen compounds extracted in the instant invention are either similar to or the same as those described in Column 2 of the '676 disclosure, the means by which the process is undertaken in the instant invention is very different from that disclosure.

In the October 1983 issue of *Chemical Engineering* an article by Desai and Madgavkar, recognizes a method to remove catalyst-poisoning nitrogen compounds from shale oil by solvent extraction with a formic acid/water solvent prior to hydrotreating. The advantage of this technique is a lowering of the hydrogen consumption and a reduction of the nitrogen content to a tolerable level feasible for downstream processing of the shale oil. It should be noted that the nitrogen compounds indigenous to the shale oil are unique and will not necessarily behave in the same manner as the nitrogen compounds indigenous to petroleum oils. Further, shale oil liquids are derived from a polymeric material, "kerogen", which is thermally decomposed into liquids which contain the nitrogen molecules. Petroleum oils are formed by biological and chemical action of nature over a much longer period of time, are more mature than shale-derived oils and have a chemical constituency far different from shale-derived oils. Also, the starting materials in formulation of the petroleum oil versus the shale oil are very different and produce a lower and different content of nitrogen compounds for the petroleum oil than the shale oil. The method of nitrogen extraction in regard to the latter can simply not be extrapolated to the former.

The addition of inorganic acids to petroleum oils to reduce the quantity of nitrogen compounds has long been established. For example, in U.S. Pat. No. 2,35Z,Z36 anhydrous hydrogen chloride is added to improve a charge stock for catalytic cracking. A dilute acid, such as sulfuric acid, is disclosed in U.S. Pat. No. 1,686,136 to complex nitrogen compounds existent in a California-derived crude oil. Organic carboxylic acids, sometimes referred to as low molecular weight fatty acids of high volatility have been used to complex nitrogen-bases in such disclosures as U.S. Pat. Nos. 2,263,775 and 2,263,176. While these latter two references employ a portion of the chemical mechanism utilized in the first step of this two-step nitrogen extraction process, they fail to disclose, suggest or even hint at the use of a second step to hydrotreat the recovered petroleum oil fraction to more precisely lower the content of the heterocyclic nitrogen compounds. Also, these references fail to teach the use of a combination carboxylic acid extraction step with such acids as an admixture of formic and acetic acids. This is important in light of the cross production of an acetic acid, i.e., formic acid will usually be present as an impurity. Thus, it may be economic and advantageous to use a mixture of such co-produced carboxylic acids as the extractant of the first extraction step.

A patent issued to Johnson et al , U.S. Pat. No. 4,409,092 in 1983, teaches formation of a high nitrogen fraction and a low nitrogen fraction, which is then subjected to phosphoric acid extraction. The fraction high in nitrogen content is catalytically cracked and then either hydrotreated or sent to phosphoric acid extraction. There is no disclosure by Johnson et al of a process whereby extraction of a petroleum oil is made in the presence of a $C_1$ to $C_{15}$ carboxylic acid extraction agent and then subsequent hydrotreatment. The patent teaches at Column 14 that use of acetic acid is not desirable since such use would result in esterification of the materials being treated.

A shale oil feedstock is treated in a patent issued to Kuk et al, U.S. Pat. No. 4,483,763 in 1984. This is not a petroleum crude oil process and the nitrogen components indigenous to the shale oil are different from the nitrogen compounds of petroleum oil as taught by above-discussed Johnson et al (see Column 1, line 35+). Kuk et al hydrotreat prior to division into a nitrogen lean and a nitrogen rich stream. After a hydrotreating step, which is necessary to eliminate the more easily hydrogenatable components, the intractable nitrogen components are then subject to solvent extraction. The cxtractant component utilized in Kuk et al is an organic polar solvent such as an alkanol. This is an active and mandatory ingredient in the Kuk et al extraction as demonstrated by Examples 8–10 (Col. 5) where no carboxylic acid is present yet a reduction in nitrogen content is realized. The specific example of this reference discloses that the feed material contains 2.05 percent nitrogen. The segregated middle distillate cut contains only 0.53 percent nitrogen (a smaller amount of nitrogen compounds), which is subjected to solvent extraction.

A process is described in Lillard, U.S. Pat. No. 3,551,324, to improve a transformer oil by acetic acid extraction followed by hydrorefining. The disclosure is made that basic nitrogen components are removed by the acetic acid extraction step but that the sulfur compounds, which are natural oxidation inhibitors for the transformer oil, are left behind. The patentees require that the acetic acid be concentrated and have no more than 5 w% water. This requirement is outside the range of carboxylic acid in applicants' extraction step which provides for a content of from 20% up to 95%, and preferably from 25% to 80% concentrated lower carboxylic acid.

In 1957 a catalytic cracking process issued to Junk et al, U.S. Pat. No. 2,800,427, to treat with acid a feed material passing to a catalytic cracking unit. The acid treatment will eliminate sludgy precipitates known to cause problems during catalytic cracking. The patentees require two active solvents in order to form the requisite PreciPitate. The extraction step can be performed with either an inorganic acid or an organic acid in a like manner. The specific acid exemplified is $H_2SO_4$.

OBJECTS AND EMBODIMENTS

An object of this invention is to provide a process for the extraction of heterocyclic nitrogen compounds from a petroleum oil by means of a two-step process whereby the indigenous conditions of temperature and pressure of the feed material are utilized to form a high temperature extraction and thereby eliminate precursor heat removal steps normally associated with a typical extraction system.

Another object of this invention is to provide a process for extracting basic heterocyclic nitrogen compounds from a petroleum oil or a fraction thereof, such as a vacuum gas oil, by means of first extracting the petroleum oil with a extractant comprising a carboxylic acid wherein the petroleum oil recovered after extraction is subjected to hydrotreating.

Another object of this invention is to provide for an extraction process whereby if residuum extractant is complexed with the petroleum oil, the damage to downstream hydrotreating catalyst is mitigated.

Another object of this invention is to provide a process for the convenient two-step removal of basic heterocyclic nitrogen compounds by first extracting with an extraction agent to remove hard to treat heterocyclic nitrogen compounds and subsequently hydrotreating to further reduce the content of the heterocyclic nitrogen content.

BRIEF DESCRIPTION OF THE INVENTION

In this invention a two-step heterocyclic nitrogen removal process functions on a crude oil or fraction thereof to excise heterocyclic nitrogen compounds therefrom. The first step entails extraction with a lower carboxylic acid to remove difficult to excise heterocyclic nitrogen compounds. The second step concerns hydrotreatment in the presence of hydrogen and a catalyst to further remove the undesirable heterocyclic nitrogen compounds. This two-step process utilizes the indigenous qualities of the feed material to perform the two-phase extraction upstream of distillation in a more feasible manner to reduce capital costs in retrofitting a refinery process to perform this basic nitrogen removal system. No yield change is suffered as a consequence of this energy and equipment saving process.

DETAILED DESCRIPTION OF THE INVENTION

The present invention is not concerned with how the petroleum oil is derived having the basic nitrogen compounds contained therein. The various fossil fuels may be either those naturally derived from geological sources or those previously treated to modify the molecular structure of same. Thus, crude oils from such fields in Mexico, California and Texas, which are very high in nitrogen compounds, are clearly contemplated to be within the scope of this invention. Also, gas oils and other refinery streams such as fluid catalytic cracking feed material, coker gas oils, vacuum distillate oils etc. are contemplated to be within the confines of this invention. If desired, the petroleum oil may be distilled or fractionated in a separation zone prior to extraction to concentrate the problem causing nitrogen compounds into a select special stream, i.e., a distillate bottoms stream. In this manner, a refiner may quickly arrive at a processable stream and concentrate all of the nefarious nitrogen-containing compounds into a segregated portion of the refinery.

The bottom stream removed from a distillation unit will usually have a temperature of above 400° F. Prior techniques utilized to extract basic nitrogen components have required the removal of heat by means of direct heat removal or indirect heat exchange with another refinery stream having a lower temperature than the distillate bottoms stream. In prior techniques the extracted streams are heated prior to distillation to distill acid and water for their recovery for recycle purposes. This cooling prior to extraction and heating after extraction involves additional processing equipment such as heat exchangers and the like which adds a tremendous cost in capital expenditures and involves more operating costs for the extraction process.

Applicants have invented a simplified process scheme in which most of the cooling and heating is eliminated and the associated process hardware to perform same is no longer necessary. Applicants' invention uses the hot temperature bottoms from a distillation column at a temperature of 400° F. to 800° F. and passes that stream to the extraction step without any cooling. The operating pressure is between 5 and 100 atmospheres to prevent flashing of the solvent and of the water. After respective phase separation, the raffinate and extract streams are distilled at higher temperatures in the respective distillation columns by a reduction in pressure. The reduction in pressure acts to flash the distilled materials and provide a better separation of the overhead and bottom streams of the downstream distillation units. This invention takes advantage of the relatively low boiling points of water and organic acids as compared to the oil components. Since the extraction is carried out at a higher temperature, the kinetics are fast and smaller size extraction equipment is required to treat the same amount of oil. Phase disengagement and separation is enhanced due to higher temperatures which lower viscosities o: both separatory phases.

The extraction agent utilized in the first step o: this two-step extraction-hydrotreating process is commonly referred to as a complexing or extraction agent and comprises an aliphatic organic carboxylic acid. It is preferred that these carboxylic acids be limited to 1 to 15 carbon atoms such as exemplified by formic acid, acetic acid, propionic acid, n-butyric acid, isobutyric acid, valeric acid, trimethylacetic acid, caproic acid, n-heptylic acid, caprylic acid, pelargonic acid, nonanoic acid, decanoic acid, undecanoic acid, dodecanoic acid, tridecanoic acid, tetradecanoic acid, pentadecanoic acid, etc. It is preferred that the aliphatic carboxylic acid be present in admixture with another aliphatic carboxylic acids. In this manner the neat production product of acetic acid, which usually contains some formic acid, can be used directly as the extraction agent without any purification step. It is also contemplated that the $C_1$ to $C_{15}$ aliphatic carboxylic acid be substituted by a moiety chosen from the halogen group of the Periodic Table. Such halogen moieties are one or more of fluoro-, chloro-, bromo-, and iodo-moieties. Exemplary of these substituted carboxylic acids are fluoroacetic acid, chloroacetic acid, bromoacetic acid, iodoacetic acid, dichloroacetic acid, trichloroacetic acid, alpha-chloropropionic acid, beta-chloropropionic acid, etc.

The aliphatic carboxylic acids having from 1 to 15 carbon atoms or the $C_1$ to $C_{15}$ halo-substituted carboxylic acids may be present conjunctly with an inert cosolvent. This cosolvent is described as being inert in character in that it does not function as a complexing agent nor the heterocyclic basic nitrogen compound. It is necessary in some cases to have this cosolvent present to facilitate intimate phase contact between the two-phase system of the petroleum oil and the aqueous phase containing the aliphatic carboxylic acid. These cosolvents can be considered a mixing means or as an aid to a mixing means. Examples of such inert cosolvents comprise $C_5$ to $C_{10}$ paraffins such as pentane, hexane, heptane, octane, nonane and decane; $C_1$ to $C_{10}$ alkanols such as methanol, ethanol, butanol, propanol, pentanol, hexanol, heptanol, octanol, nonanol, decanol, and a naphtha solvent boiling in the range of 120° F. to about 450° F. or even any admixture of the respective cosolvents.

The quantity of $C_{1-15}$ aliphatic carboxylic acids necessary to complex the heterocyclic basic nitrogen compounds is dependent on the quantity of heterocyclic basic nitrogen compounds existent in the petroleum oil feedstock which is to be treated via the extraction agent. In the practice of this invention, it is preferred that at least one mole of carboxylic acid be present for each mole of heterocyclic basic nitrogen compound present in the petroleum oil. Most preferably, 1.5 mols of carboxylic acid per mole of the heterocyclic basic nitrogen compound will be present in the extraction zone having two phases contained therein. It is possible that a larger amount of the carboxylic acid can be utilized than is necessary to adequately complex the heterocyclic basic nitrogen compounds, however, when an over stoichiometric amount of carboxylic acid is utilized, an undesirable hardship is realized in the downstream separation of the aqueous carboxylic acid phase from the enhanced petroleum oil fraction having an elevated content o: heterocyclic basic nitrogen compounds.

The concentration of the lower carboxylic acids in the aqueous phase is an important aspect of this invention. The concentration should be less than 95 w% lower carboxylic acid in the aqueous phase and preferably less than 80 w% lower carboxylic acid in the aqueous phase. It is preferred that the lower concentration limits be above 20 w% carboxylic acid and, most preferably above 25 w% carboxylic acid in the aqueous phase. Concentrated aliphatic carboxylic acids are not viable for this process. For the purposes of this invention a concentrated solution of aliphatic carboxylic acid is defined as having 95% or more carboxylic acid based on weight of the acid in the aqueous phase.

The first process step of this invention concerns a two-phase system nor complexing o extracting the heterocyclic basic nitrogen compounds. One phase is the petroleum oil containing the nefarious heterocyclic basic nitrogen compounds while the second phase is an aqueous phase having a $C_{1-15}$ aliphatic carboxylic acid-complexing agent dissolved therein. The quantity of water in the liquid phase must be sufficient to insure creation and maintenance of a two-phase system.

The amount and tyPe of heterocyclic basic nitrogen compounds is easily ascertained by a chemical analysis of a fungible sample of the applicable petroleum oil or fraction of the petroleum oil. While not wishing to be bound by any specific heterocyclic basic nitrogen compound, it is believed that most prevalent nitrogen compounds in petroleum oils include at least one of azetidines, azoles, aziridines, pyridines, pyrollidines, benzimidazoles, 1,3-benzisodiazoles, 1,2-benzisoxazines, benzofurans, pyrimidines, quinolines, quinoxalines, 1,2,3,4-tetrazoles, pyridazines, piperazines, piperdines, petazines, tetrahydroquinolines, phenthridines.

The extraction conditions utilized in the two-phase system include a temperature of from 200° F. to 700° F., and a pressure of from 2 atmospheres to 100 atmospheres. A preferred range of extraction conditions includes a temperature of from about 300° F. to about 650° F., and a pressure of from about 5 atmospheres to about 80 atmospheres. A most preferred range of extraction conditions includes a temperature of from about 350° F. to about 500° F., and a pressure of from about 10 atmospheres to about 30 atmospheres. The extraction section utilized in this invention can be any conventional solvent extraction equipment which provides a mixing means for adequate intermixture of the two-Phase system. Such mixer settlers or columns are commonplace in the art and are exemplified by such apparatus as a rotating disc contactor, a pulsating column, motionless mixer, or the like. Addition means are also provided for the entry of the extractant to the extraction zone. This means can comprise any type of valve or conduit necessary to provide ready access to the interior of the extraction zone. The addition means can be constructed to pass new extractant, new and recycle extractant, or only recycle extractant, to the extraction zone.

It is also contemplated that more than one stage of contacting may be used and that the extractions may be repeated to continuously provide a petroleum oil effluent with smaller quantities of the heterocyclic basic nitrogen compounds. It is preferred that the extraction is carried out at sufficiently high temperatures to facilitate intimate mixing of both phases and that, if desired, at least one of the above cosolvent can be present to give better mixture of the components.

After extraction, the petroleum oil stream is withdrawn from the extraction zone and passed to a catalytic-hydrotreatment step to remove further heterocyclic nitrogen components. If desirable, this stream may be preheated to a temperature in excess of 400° F. to in excess of 700° F. and distilled previous to hydrotreating. Regardless of the distillation step, the petroleum oil is subjected to catalytic hydrotreatment. It is preferred that this hydrotreatment be conducted under conditions considered mild, inclusive of a temperature of from about 600° F. to about 800° F., a pressure of about 25 atmospheres to about 150 atmospheres and a liquid hourly space velocity of from about 0.5 to 5. The hydrotreating is performed in the presence of hydrogen and a hydrotreating catalyst which can comprise a refractory, inorganic oxide support having deposited thereon various metals of the Periodic Table selected from Group VIII and/or Group VIB of the Periodic Table. Specific examples of these hydrotreating catalysts include a platinum catalyst modified with molybdenum or a nickel catalyst modified with tungsten. The actual weight percent of these metals necessary to perform hydrotreating is clearly within the confines of those of reasonable skill in the art and need not be exemplified any further herein.

An intermediate distillation step is performed to enhance the quantity of nitrogen components being passed to the hydrotreating zone. This enhancement step usually will comprise a distillation of the petroleum oil stream withdrawn from the extraction zone where the top temperature of the distillation is maintained at a temperature of from about 200° F. to about 500° F. and a bottom temperature of about 400° F. to about 700° F. The temperatures maintained in this distillation zone will be characteristic of the petroleum feed in question and may vary substantially, depending on the nitrogen content desired, to be concentrated in the bottoms stream. Normally, the petroleum oil stream will be divided into two steams, one having a deficiency of heterocyclic basic nitrogen compounds, compared to the stream withdrawn from the extraction zone, and the other stream being rich in heterocyclic basic nitrogen compounds compared to the heterocyclic basic nitrogen content of the extraction zone effluent. In such an embodiment an extractant recycle stream may be derived from the top of the distillation column and recycled to the extraction zone. In addition a recycle stream may be derived from the downstream hydrotreatment zone and passed back to the extraction step.

A second stream withdrawn from the extraction zone will comprise an aqueous phase comprising an aliphatic carboxylic acid extractant with an increased quantity of heterocyclic nitrogen compounds. This stream is passed to a secondary separation zone where the aqueous phase with the carboxylic acid is separated, by separation means, from the heterocyclic nitrogen compounds. A waste stream comprising the heterocyclic nitrogen compounds can be discharged in an economically viable manner or can be further processed to remove the mineral oils inherent therewith. The recovered aqueous phase containing the aliphatic carboxylic acid is considered at least partially as a recycle stream which can be re-entered to the two-phase separation step through the addition means previously discussed. The separation conditions undertaken in this second separation zone comprise a temperature of from 200° F. to 700° F. and a pressure of from 0.05 atmosphere to about 2 atmospheres.

Previous process techniques have required heating of the raffinate and extract from the extraction process in order to have a more viable distillation. As result of the high temperature extraction conditions the heating of both of these streams is not necessary in order to provide the same yield of the particular so]vent and oil phases. Thus, the process of this invention eliminates not only the cooling step upstream of extraction but also the heating step intermediate extraction and distillation.

DETAILED DESCRIPTION OF THE DRAWINGS

Figure 1:
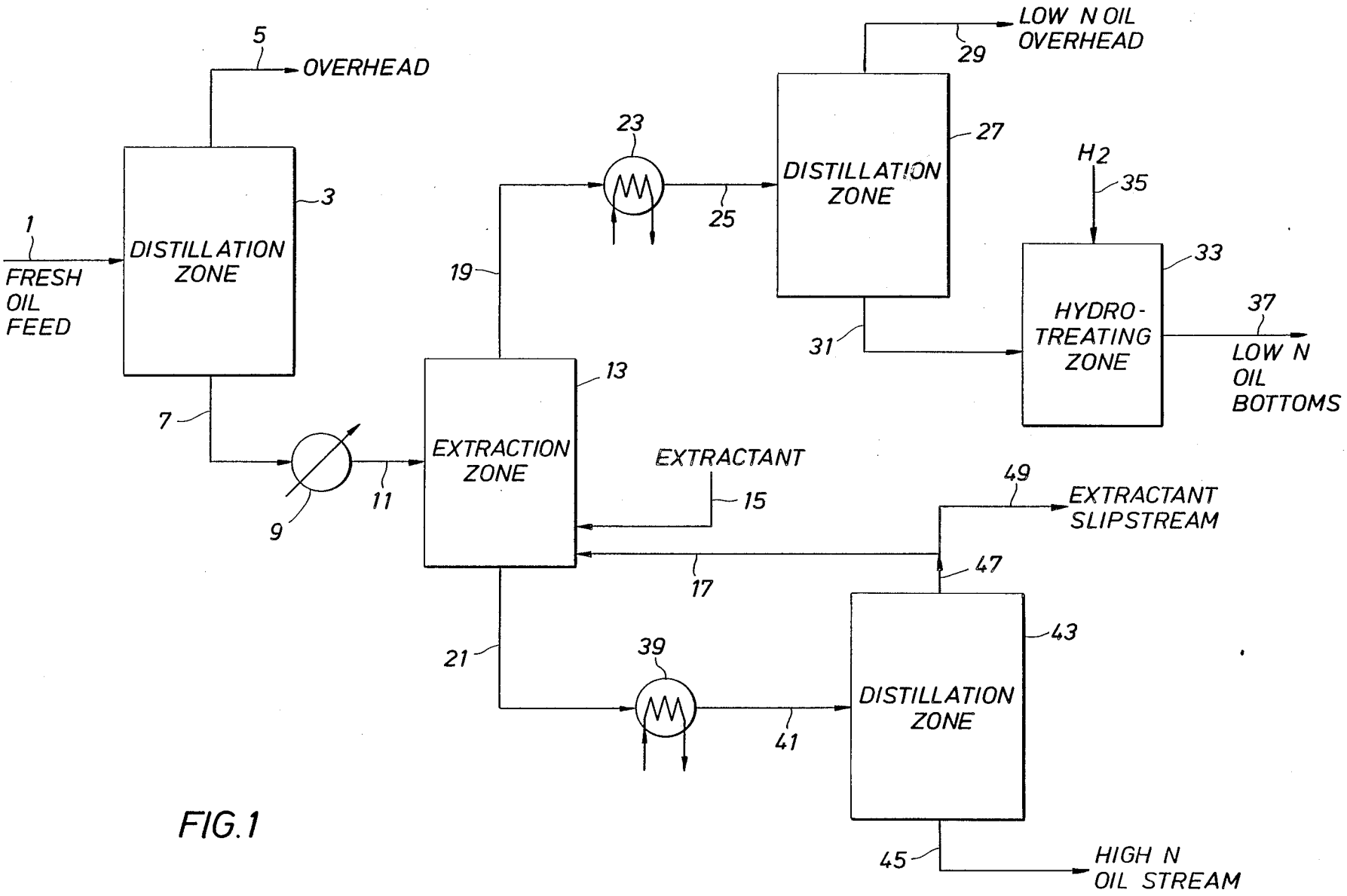
FIG. 1 is a flow scheme of a two-step extraction system where nitrogen compounds are removed without resort to the energy and capital saving aspects of the process of this invention.

In FIG. 1, fresh petroleum oil or a fraction thereof having a relatively high content of nitrogen is added through conduit 1 to distillation zone 3 for initial distillation. It is conceivable that this distillation can be atmospheric or vacuum distillation, if desired. The fresh oil feed in conduit 1 may be heated in a heating zone (not shown) previous to the addition to the distillation zone. In this manner only a portion of the original feed material is passed to ultimate extraction with the lower carboxylic acid. An overhead stream from distillation zone 3 is removed in conduit 5 and passed to other refining processes as would be evident to one of reasonable skill in the art. Bottoms stream 7 is withdrawn from the distillation zone at a temperature of about 400° F. to about 800° F. and a pressure of from about 1 atmosphere to about 100 atmospheres and passed to heat removal zone 9 wherein heat is removed from this zone by means of indirect heat exchange or direct heat exchange with a cooling fluid. Downstream of heat removal zone 9, in conduit 11, a feed material resides for passage to extraction zone 13 maintained at a temperature of from about 60° F. to about 200° F. and a pressure of from about 1 atmosphere to about 20 atmospheres. In extraction zone 13, an extractant is added by means of conduit 15, or extractant recycle conduIt 17, for two-phase separation of the oil and water phase in extraction zone 13. The preferable concentration of the acid added in extractant addition 15 or extractant recycle zone 17, or both, is preferably from about 25% lower carboxylic acid to about 80% lower carboxylic acid by weight of the aqueous phase. It is preferred that multiple numbers of lower carboxylic acid can be utilized such as exemplified by a combination of formic acid and acetic acid.

The extraction which occurs in extraction zone 13 forms two phases, an extraction raffinate phase which is withdrawn in conduit 19 and an extractant extract phase withdrawn in conduit 21. Extraction raffinate phase 19 is passed to heating zone 23 wherein the temperature of the extraction raffinate phase is increased to a temperature of about 300° F. to about 600° F. and a pressure of about 1 atmosphere to about 10 atmospheres. After removal from the heating zone, in conduit 25, the heated extraction raffinate phase is passed to distillation zone 27 for distillation into a low nitrogen content oil overhead 29 and hydrotreating feed material in conduit 31. The latter is passed to hydrotreating zone 33 wherein additional hydrogen via conduit 35 is added, and in the presence of a hydrotreating catalyst, the extraction raffinate phase derived in bottoms stream 31 is hydrotreated to form a low nitrogen content oil bottoms stream removed in conduit 37 as the main product of this extraction process.

Returning to extraction extract phase 21, the same is passed to heating zone 39 where the extraction extract phase is heated to a temperature of about 200° F. to about 600° F. and a pressure of from about 1 atmospheres to about 10 atmospheres. This heated extraction extract phase is passed to conduit 41 as a feed stream to distillation zone 43. In the latter the extract and aqueous phase are separated from a high nitrogen oil stream removed as a bottoms stream in conduit 45 and passed to further refining processing taking into consideration, of course, the high nitrogen content. An extractant material is withdrawn from distillation zone 43 in overhead stream 47 which is divided between extractant zone recycle stream 17 and an extractant slip stream 49.

Figure 2:
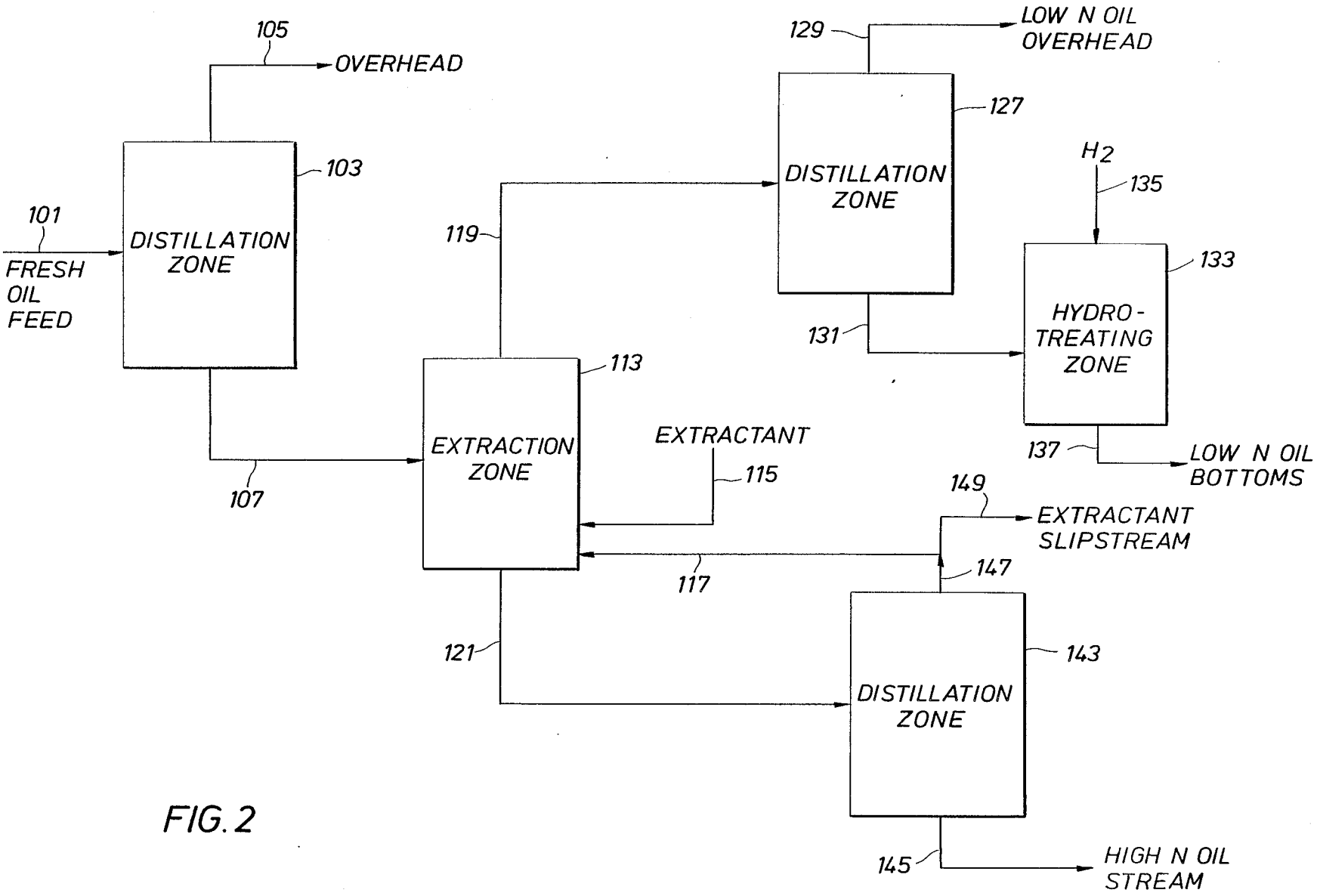
FIG. 2 is flow scheme of the instant two-step extraction system of this invention where nitrogen compounds are removed utilizing the energy efficient process as hereinafter explained.

This embodiment depicts cooling bottoms stream 7 in heat removal zone 9, which is different from the instant invention shown in FIG. 2 where heat removal zone 9 has been eliminated. In addition, heating zones 23 and 39 are shown in FIG. 1 but have been eliminated from the process exemplified by FIG. 2.

In FIG. 2 a fresh feed material in conduit 101 is passed to distillation zone 103 for removal of a portion of the crude oil. This distillation zone may comprise a vacuum distillation zone or an atmospheric distillation zone and the feed stream in conduit 101 may be preheated prior to entry to distillation zone 103. An overhead stream in conduit 105 is removed from distillation zone 103 and passed to further refining areas to recover the indigenous hydrocarbon value of this stream. A bottoms stream in conduit 107 is removed from distillation zone 103 at a temperature of 400° F. to about 800° F. and a pressure of from about 1 atmosphere to about 100 atmospheres. It is important to note that in deference to FIG. 1 bottoms stream 107 is passed to extraction zone 113 without any cooling or heat removal at all.

In extraction zone 113 an extract raffinate phase 119 is withdrawn from the top portion of extract zone 113 and an extraction extract phase 121 is withdrawn from the bottom portion of extraction zone 113. Extractant is added in the applicable concentrations of 30% to 80% by weight lower carboxylic acid in conduits 115 and/or in recycle extractant conduit 117.

The extraction raffinate phase is not heated and heat is not needed in order to perform distillation in distillation zone 127. This elimination of the healing step dIstinguishes this process from the process of FIG. 1, i.e. in that heating zone 23 is obviated. In distillation zone 127 a low nitrogen oil overhead is removed in conduit 129 while a hydrotreating zone feed material is withdrawn in conduit 131. This material is hydrotreated in hydrotreating zone 133 in the presence of hydrogen added in conduit 135 and in the presence of a suitable catalytic material that will aid the hydrotreating step. A low nitrogen oil bottoms stream is withdrawn in conduit 137 and passed to other refining procedures to recover the IndIgenous hydrocarbon content of the low nitrogen oil bottoms stream. This is considered the product stream of this invention.

Returning to extraction extract stream 121, the same is passed to distillation zone 143. This is done without the aid of heating as in heating zone 39 of FIG. 1. The extraction extract stream in conduit 121 is passed to distillation zone 123 at a temperature of about 200° F. to about 700° F. and a pressure of from about 0.05 atmospheres to about 2 atmospheres. A high nitrogen oil stream is removed in conduit 145 and passed to further refining areas taking into account, of course, the high nitrogen content of the stream. An overhead stream is withdrawn from distillation zone 143 in conduit 147 which is split between a recycle extractant stream 117 and an extractant slip stream removed in conduit 149.

A comparison of the drawings of FIG. 1 and FIG. 2 show the benefits of this process. )n FIG. 1 heat removal zone 9, heating zone 23, and heating zone 39 are not necessary in the flow scheme of FIG. 2. This elimination of the three entities results in an easier distillation in re flashing of the hydrocarbon material in streams 119 and 121 without loss of yield in streams 129, 137 and 145.

ILLUSTRATIVE EMBODIMENTS

The illustrative embodiments described herein are exemplary of the extractant capabilities of the lower earboxylic acid and do not make heat balance comparisons with a process not using heat removal zone 9 and heating zones 23 and 29 as shown in FIG. 1 above. The examples are not set forth to have a limiting effect upon the claims hereinafter presented. While these examples were performed on a batch scale method, one of even modicum skill in the art will readily realize the extrapolation of these tests to the flow scheme as above-described in FIG. 2.

In each of Examples 1 through 3, a vacuum gas oil with the following properties was treated with the described carboxylic acid.

TABLE I

| VACUUM GAS OIL | | | |
|---|---|---|---|
| Sulfur | | 1.1 wt % | |
| Total nitrogen | | 0.45 wt % | |
| Basic nitrogen content | | 1658 ppm | |
| Ni | | 1.63 ppm | |
| V | | 0.35 ppm | |
| degrees H | | 11.35 wt % | |
| C | | 86.43 wt % | |
| O | | 0.64 wt % | |
| Boiling Point IBP | 472° F. | 25% | 709° F. |
| 50 | 816° F. | 75% | 914° F. |
| Final BP | 1124° F. | | |

EXAMPLE 1

In this example 50 gms of a sample of the vacuum gas oil of Table I were shaken for about 15 minutes at ambient temperature with 50 gms of a water solution containing approximately 70 percent acetic acid. Two phases were allowed to separate at about 113° F. to about 122° F. for approximately 15 minutes. The phases were separated and the oil phase thereafter analyzed nor its quantity of basic nitrogen compounds. The basic nitrogen content was reduced to 1228 ppm representing a 26 percent decrease from the nitrogen value of the vacuum gas oil. Very little sulfur, nickel or vanadium were removed from the vacuum gas oil.

EXAMPLE 2

In this example 50 gms of the vacuum gas oil were shaken for about 15 minutes at room temperature with 50 gms of a water solution containing approximately 90 percent acetic acid. The two phases were allowed to separate at room temperature for about 15 minutes. The phases were separated and the oil phase analyzed. The basic nitrogen content was reduced to 611 ppm representing a 63 percent decrease from the 1658 ppm basic nitrogen in the vacuum gas oil. Again, very little sulfur, nickel or vanadium were removed from the vacuum gas oil.

EXAMPLE 3

In this example, 3 kilograms of the vacuum gas oil were stirred with about 3 kilograms of an approximately 70 percent acetic acid solution in water. A motor-driven stir means with an impeller was used to stir the mixture for two to three hours. The phases were allowed to separate over a period of about 12 hours and the oil phase analyzed. The oil phase contained about 890 ppm basic nitrogen representing a decrease of about 46 percent from the 1658 ppm basic nitrogen content of the vacuum gas oil.

EXAMPLE 4

This example is exemplary of the hydrotreating contemplated on the oil phases recovered with a diminished basic nitrogen content, i.e. Examples 1, 2, and 3. This hydrotreating can be affected in the presence of a hydrotreating catalyst comprising nickel and molybdenum on alumina. The hydrotreating can be affected at conditions including a temperature of 600° F. to 800° F. and a pressure of 1 to 100 atmospheres to acquire a hydrotreated Product. If desired, distillation upstream of this hydrotreating step can be effected to form a concentrated nitrogen content in a bottoms stream from a distillation zone for subsequent hydrotreating. The basic nitrogen content of the oil phase recovered after hydrotreating with both the embodiment of the intermittent preheating and distillation, and without such embodiments, contains a small quantity of heterocyclic nitrogen compounds.

What is claimed is:

1. A process for the removal of heterocyclic nitrogen compounds from a petroleum crude oil or fraction thereof, without heat removal of said crude oil or fraction thereof, wherein said petroleum crude oil or fraction thereof is at a temperature of from about 400° F. to about 800° F. at a pressure of from 1 atmosphere to 100 atmospheres, which process comprises treating said petroleum crude oil or fraction thereof, which is rich in basic heterocyclic nitrogen compounds, without cooling of said stream in a two-phase extraction zone comprising an extraction consisting essentially of an aqueous solution of a lower carboxylic acid in a concentration of from about 20 up to 95 weight percent in aqueous phase, at separation conditions, to extract, at a temperature of from about 300 to 500° F. and a pressure of from about 2 atmospheres to about 100 atmospheres wherein said pressure is maintained within said extraction zone to prohibit solvent flashing during said extraction at the temperature at which said petroleum crude oil or fraction is received in said two-phase extraction zone without cooling, said basic heterocyclic nitrogen compounds with said lower carboxylic acid and thereby remove at least a portion of said basic heterocyclic nitrogen compounds from said petroleum crude oil or fraction thereof and to form a raffinate stream comprising a petroleum oil with a lean content of basic heterocyclic nitrogen compounds and an extract stream comprising an aqueous phase containing said lower carboxylic acid and having an increased content of basic heterocyclic nitrogen compounds, passing said raffinate stream to a distillation step, without heating, to distill said raffinate stream at a temperature of 300° F. to about 700° F. and a pressure of 1 atmosphere to 10 atmospheres to produce a first distillation overhead stream and a first distillation bottoms stream and passing said bottoms stream to a catalytic hydrotreatment zone to hydrotreat said bottoms stream in the presence of hydrogen and a catalytic composition of matter, at hydrotreatment conditions, to remove basic heterocyclic nitrogen compounds and recovering a hydrotreated petroleum crude oil stream having a lower content of basic heterocyclic nitrogen compounds than present in said raffinate stream and passing said extract stream to a distillation step, without heating, to distill said extract stream, at a temperature of from about 200° F. to about 700° F. and a pressure of 0.05 atmosphere to 2 atmospheres to produce a second distillation overhead stream and a second distillation bottoms stream having a high content of nitrogen-containing compounds and recycling at least a portion of said second distillation overhead stream to said extraction zone and recovering said second distillation bottom stream.

2. The process of claim 1 wherein said extraction conditions comprise a temperature of from 300° F. to about 500° F. and a pressure of from 5 to 80 atmospheres.

3. The process of claim 1 wherein said extraction conditions comprise a temperature of from 350° F. to 500° F. and a pressure of from about 10 atmospheres to 30 atmospheres.

4. The process of claim 1 wherein said crude oil fraction is a vacuum gas oil or a coker gas oil.

5. The process of claim 1 wherein said extractant consisting essentially of a lower carboxylic acid is an aliphatic carboxylic acid having from 1 to 15 carbon atoms.

6. The process of claim 5 wherein said aliphatic carboxylic acid comprises a mixture of two or more aliphatic carboxylic acids.

7. The process of claim 5 wherein said aliphatic carboxylic acid is selected from the group consisting of acetic acid, oxalic acid, formic acid, propionic acid, n-butyric acid and mixtures thereof.

8. The process claim 1 wherein said extractant agent is present with an inert cosolvent selected from the group consisting of a paraffinic hydrocarbon having from 5 to 10 carbon atoms, an alkanol having from 1 to 10 carbon atoms and a naphtha having a boiling point of from 180° F. to 450° F.

9. The process of claim 5 wherein said aliphatic carboxylic acid is substituted with a halo moiety selected from the group consisting of chloro-, fluoro, bromo- and iodo- moieties.

10. The process of claim 9 wherein said halo-substituted carboxylic acid is chloroacetic acid.

11. The process of claim 9 wherein said halo-substituted carboxylic acid is trifluoroacetic acid.

12. The process of claim 1 wherein said hydrotreatment conditions comprise a temperature of from 600° F. to about 850° F., a pressure of from about 25 atmospheres to about 150 atmospheres and liquid hourly space velocity of from about 0.5 to 5.0 per hour.

* * * * *